US009776821B2

(12) United States Patent
Klein

(10) Patent No.: US 9,776,821 B2
(45) Date of Patent: Oct. 3, 2017

(54) DEVICE FOR STREAM-FEEDING AND PLACING SHEETS ONTO A STACK

(71) Applicant: BIELOMATIK LEUZE GMBH + CO. KG, Neuffen (DE)

(72) Inventor: Hansjoerg Klein, Aichwald (DE)

(73) Assignee: bielomatik LEUZE GMBH + CO. KG, Neuffen (DE)

( * ) Notice: Subject to any disclaimer, the term of this patent is extended or adjusted under 35 U.S.C. 154(b) by 0 days.

(21) Appl. No.: 14/407,960

(22) PCT Filed: Jul. 23, 2013

(86) PCT No.: PCT/EP2013/065453
§ 371 (c)(1),
(2) Date: Feb. 9, 2015

(87) PCT Pub. No.: WO2014/026827
PCT Pub. Date: Feb. 20, 2014

(65) Prior Publication Data

US 2016/0023859 A1 Jan. 28, 2016

(30) Foreign Application Priority Data

Aug. 17, 2012 (DE) ..... 10 2012 214 629

(51) Int. Cl.
*B65H 3/06* (2006.01)
*B65H 29/66* (2006.01)
(Continued)

(52) U.S. Cl.
CPC ..... *B65H 29/66* (2013.01); *B65H 29/242* (2013.01); *B65H 29/247* (2013.01);
(Continued)

(58) Field of Classification Search
CPC .. B65H 29/241; B65H 29/242; B65H 29/686; B65H 2301/4492; B65H 2601/321; B65H 2402/10; B65H 31/22
See application file for complete search history.

(56) References Cited

U.S. PATENT DOCUMENTS 3,698,709 A 10/1972 Heal
6,542,715 B2 * 4/2003 Miyamoto ..... B65H 31/22 270/58.08

(Continued)

FOREIGN PATENT DOCUMENTS

DE 102012207064 A 10/2013

*Primary Examiner* — Jeremy R Severson
(74) *Attorney, Agent, or Firm* — Andrew Wilford

(57) ABSTRACT

An apparatus for overlapping and stacking sheets, the apparatus has a housing defining a stacking area and a travel plane for the sheets, a conveyor for transporting the sheets through the housing in a travel direction along a travel plane, and an overlapping device in the housing upstream of the stacking area for producing an overlapping stream of the conveyed sheets. A brake in the overlapping device slows the conveyed sheets of the overlapping stream. Stacking elements include stops projecting upward in the stacking area and serving to position a stack formed by the conveyed sheets of the overlapping stream. A separate frame carrying the stacking elements in the stacking area above the travel plane or extending to above the supply travel plane is mounted in the housing of the apparatus so as to be movable horizontally downstream in the direction away from the overlapping device.

3 Claims, 2 Drawing Sheets

(51) Int. Cl.
*B65H 29/68* (2006.01)
*B65H 29/24* (2006.01)
*B65H 31/10* (2006.01)

(52) U.S. Cl.
CPC ..... *B65H 29/686* (2013.01); *B65H 31/10* (2013.01); *B65H 2301/44734* (2013.01); *B65H 2301/44735* (2013.01); *B65H 2402/10* (2013.01); *B65H 2402/441* (2013.01); *B65H 2406/323* (2013.01); *B65H 2601/321* (2013.01); *B65H 2701/176* (2013.01)

(56) References Cited

U.S. PATENT DOCUMENTS

| | | | | |
|---|---|---|---|---|
| 6,626,430 | B1 | 9/2003 | Schmid | |
| 8,936,242 | B1 * | 1/2015 | Ferrara | B65H 9/002 271/266 |
| 9,302,874 | B2 * | 4/2016 | Schilling | B65H 29/242 |
| 2012/0161384 | A1 * | 6/2012 | Suzuki | B65H 3/128 271/11 |

* cited by examiner

DEVICE FOR STREAM-FEEDING AND PLACING SHEETS ONTO A STACK

CROSS REFERENCE TO RELATED APPLICATIONS

This application is the US-national stage of PCT application PCT/EP2013/065453 filed 23 Jul. 2013 and claiming the priority of German patent application 102012214629.6 itself filed 17 Aug. 2012.

FIELD OF THE INVENTION

The invention relates to an apparatus for overlapping and stacking sheets, which apparatus includes an overlapping device upstream of the stacking area, having a brake for producing an overlapping stream and stacking elements arranged in the stacking area.

An apparatus of the generic type is described in German patent application DE 10 2012 207 064. Apparatuses of this type are used for stacking sheets downstream of machines with continuous transport of individual sheets, in particular downstream of crosscutting or printing machines. In a first step, by means of the overlapping device, they produce an overlapping stream from the sheets required one downstream of another, which are then placed on a stack in a second step. The length of the sheets that are normally placed on pallets, can be considerably greater than the sheet width be under 1 m and more.

German application DE 10 2012 207 064 describes a compactly constructed apparatus for stacking and placing sheets that is also able to place sheets made of sensitive papers at high speed. To this end, pneumatic transport bars, which are configured in such a way that compressed air emerges in the sheet travel direction, are above the supply travel plane as stacking elements in the stacking area. The overlapping device includes, downstream of the brake above the conveying plane, a suction belt that can be moved in the travel direction at the high supply conveyor speed and the vacuum of which can be switched on and off cyclically. Further stacking elements above the conveying plane or extending into the area above the conveying plane are an end stop, side alignment elements, suction belts in the downstream stacking area and additional suction bars between the pneumatic transport bars that prevent premature and uncontrolled sinking of a sheet out of the supply travel plane into the stacking area.

OBJECT OF THE INVENTION

The invention is based on the object, in a compactly constructed apparatus corresponding to German patent application 10 2012 207 064, of improving the accessibility for maintenance work and for rectifying faults.

SUMMARY OF THE INVENTION

According to the invention, this object is achieved in that the stacking elements acting in the stacking area on the top side of the stack, which are above the supply travel plane or extend to above the supply travel plane, are fixed in a separate frame that is mounted in the housing of the apparatus so as to be movable horizontally.

In order to rectify faults, the frame with the elements fixed thereto is moved away from the remaining elements mounted in the housing. This produces an intermediate space, into which an operator can move for maintenance work or to rectify faults, for example paper jams. The opening movement is preferably carried out in the sheet travel direction. The frame is moved thereby downstream out of the housing.

Advantageously, the frame with the elements fixed thereto can be moved completely out of the housing of the apparatus. During a grade or format change that requires a change of stacking elements, the elements newly to be used can be fixed to a second frame during the operating time. The second frame is then interchanged with the previous frame without a relatively long stoppage time being necessary to fix the elements.

BRIEF DESCRIPTION OF THE DRAWING

The apparatus will be explained in more detail below by using an illustrated embodiment illustrated schematically and in simplified form.

SPECIFIC DESCRIPTION OF THE INVENTION

Figure 1:
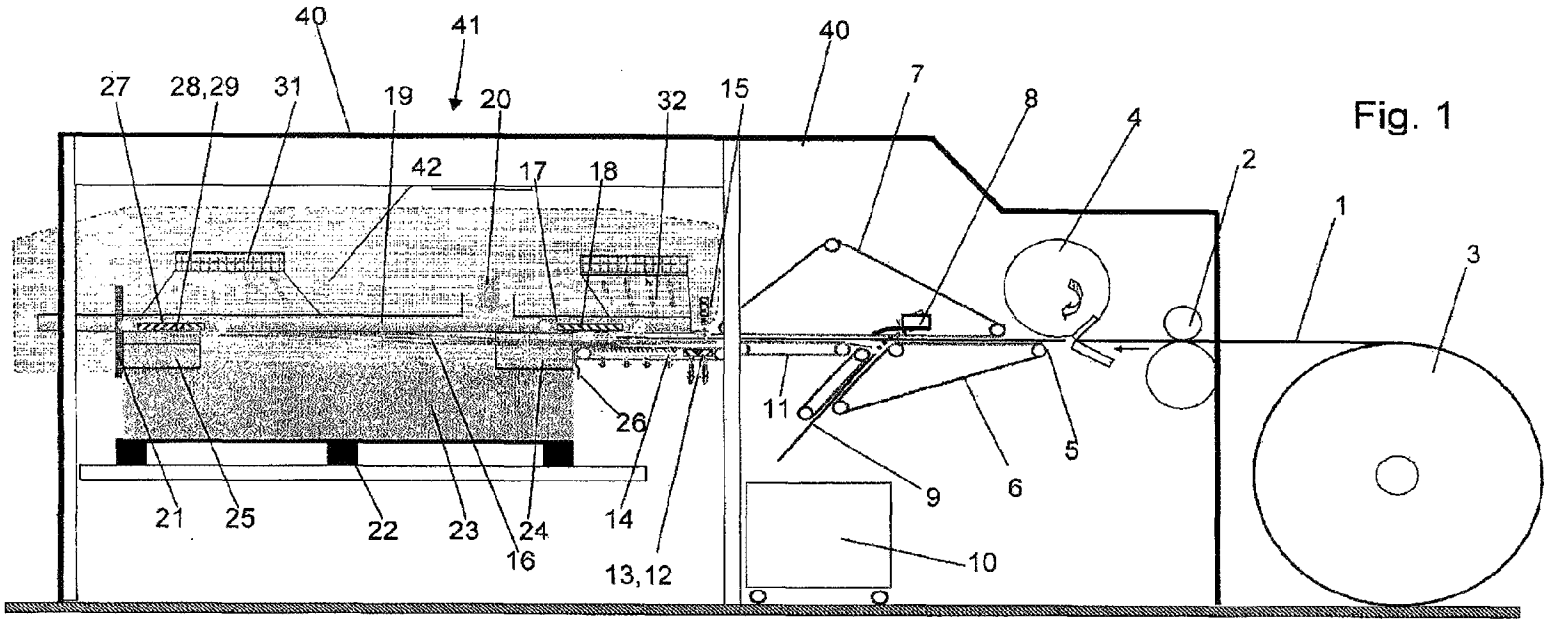
FIGS. 1 and 2 show the position of the elements during operation in a schematic illustration as a side view and partly as a plan view.
Figure 2:
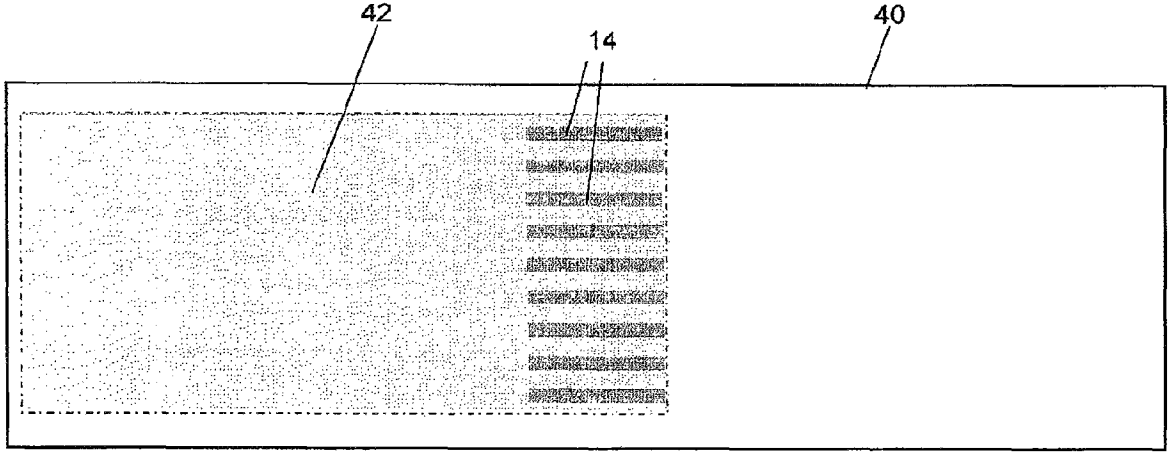
Figure 3:
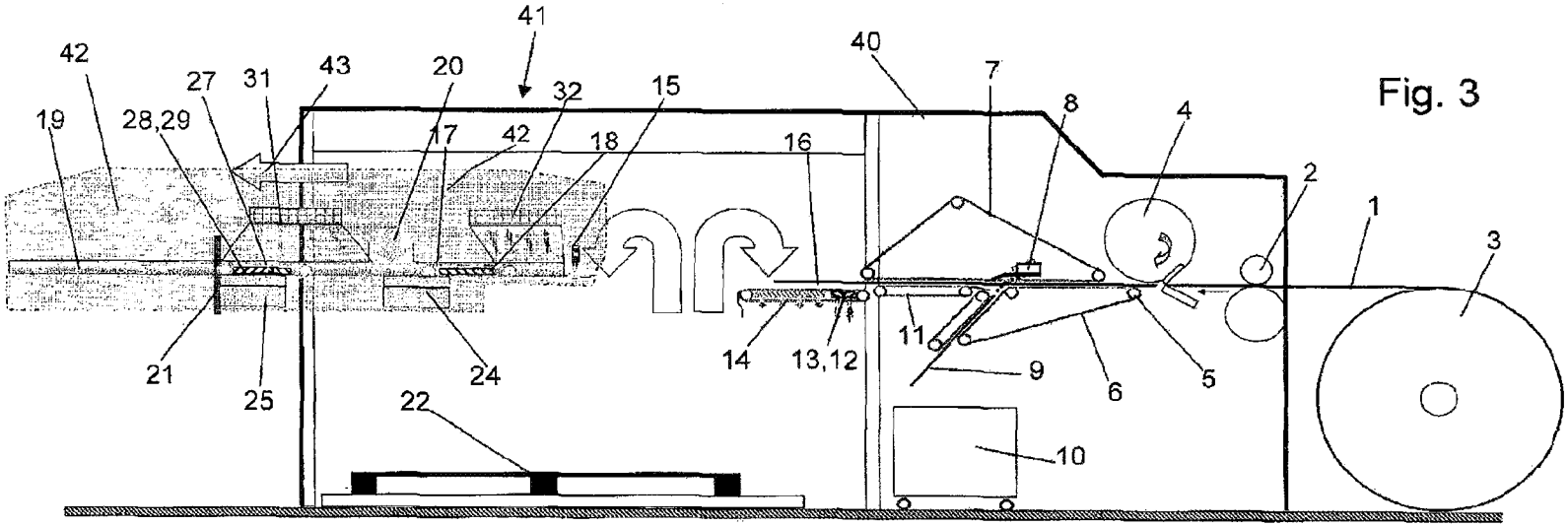
FIGS. 3 and 4 show the movement of the frame with the elements fixed thereto out of the housing, schematically as a side view and in a plan view.
Figure 4:
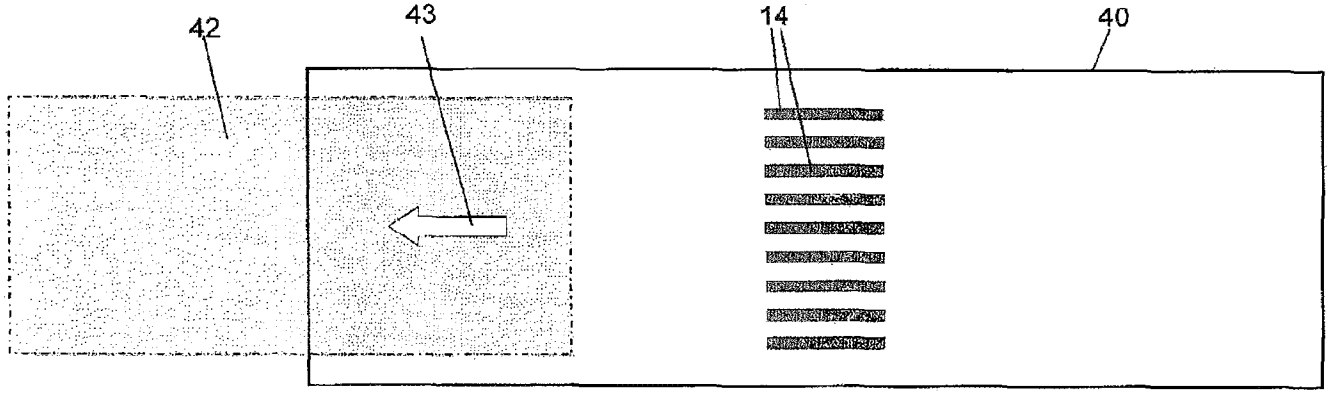

The cross cutter illustrated in the figures is used to produce paper or board sheets from a continuously supplied web 1. The product web 1 is drawn by a feed roll 2 off a roll 3 that is suspended in an unwind apparatus. Downstream of the feed roll 2 is a crosscutting apparatus 4 that includes an upper knife drum fitted circumferentially with a cross cutter, and a lower stationary knife. It is also possible for two rotating knife drums to be used. As it passes between the two knives of the crosscutting apparatus 4, the web 1 is divided up into individual sheets 5. The sheets 5 are picked up by belts 6, 7 that are above and below the travel plane of the sheets and that convey at a somewhat increased speed in order to keep the sheets 5 taut. Disposed in the area of the pull-off belts 6, 7 is a sheet diverter 8 that is used to remove damaged sheets 9. The sheet diverter 8 leads to a container 10 in which the damaged sheets 9 are collected. Downstream of the sheet diverter 8, the sheets 5 are guided between a further lower belt 11 and the upper belts 7 to the brake disposed downstream therefrom that, as part of an overlapping device, produces an overlapping stream from the sheets, which is then placed on a stack.

The brake includes at least one suction box underneath the supply travel plane and having suction openings on the top side that can be opened and closed cyclically in order to attract a sheet trailing edge by suction. In the illustrated embodiment, the brake includes two suction boxes 12, 13 that are disposed one downstream of another in the travel direction and on the top side of which slow perforated belts 14 run at the braked speed. The suction openings of the suction boxes 12, 13 can be opened and closed cyclically in order to draw the trailing edge of a sheet downward onto the slowly running belt 14. In the process, the sheet is braked to the placement speed.

Disposed above the suction boxes 12, 13 and above the conveying plane is a blower nozzle 15 that blows downward, by which the sheet trailing edge is forced downward onto the suction box 12 with an intense air stream. The blown air from the blower nozzle 15 can be switched on and off cyclically in order that, when it is switched off, the leading edge of the following sheet 5 is able to slide over the trailing edge of the preceding sheet 16. The two suction boxes 12, 13 can be activated cyclically independently of each other. This makes it possible to switch off the vacuum in the upstream suction box 12 while the vacuum in the downstream suction box 13 is still active. The leading edge of the following incoming sheet 5 thus moves faultlessly over the trailing edge of the preceding sheet 16.

In the area between the brake (suction boxes 12, 13) and the stacking area there is at least one circulating suction belt 17 extending in the travel direction above the conveying plane. Preferably, a plurality of parallel suction belts 17 is disposed transversely at a distance from one another. The suction belts 17 each run around a suction box 18 that builds up a vacuum drawing the sheet upward. In order to switch a vacuum alternately on and off again very quickly, the suction boxes 18 are connected both to a vacuum source and to a positive pressure source. By means of the circulating suction belts 17, exact control of the speed of movement and position of the newly incoming sheet 5 is possible after its trailing edge has left the belts 7 and 11.

In order to transport a sheet into the stacking area, pneumatic transport bars 19 that have nozzles on their undersides from which compressed air that is supplied from a compressed air source 20 emerges, extend through the stacking area, are disposed in parallel and can each be adjusted transversely. By means of the pneumatic transport bars 19, the leading edge of a newly incoming sheet 5 is drawn upward and held there and is transported safely at high speed over the already braked and overlapped sheet stream. To this end, the nozzles of each pneumatic transport bar 19 are configured in such a way that compressed air emerges in a sheet travel direction 43 and thus conveys a sheet 16 with the leading edge thereof against end stops 21 that stop it. The end stops 21 align the sheet leading edge. The stopped sheets 16 sink onto the top of the stack 23 resting on a pallet 22 while they are aligned laterally by alignment elements 24, 25. The alignment of the trailing edge is carried out by an alignment element 26 arranged transversely and that, just like the side alignment elements 24, 25, is vibrated.

In order to intensify the holding effect, additional flat suction nozzles 31 that are open at the bottom and apply an additional vacuum to the top side of the sheet are between the suction belts 17 and the pneumatic transport bars 19.

The leading edges of the already overlapped sheets 16 are conveyed into the stacking area in a floating manner by the pneumatic transport bars 19 and suction nozzles 31. After leaving the suction boxes 12, 13, the trailing edges of the overlapped sheets 16 are picked up by a further suction apparatus 32 and then transported as far as the placement area onto the downstream alignment element 26. In the case of specific papers, placement can also be carried out without the second suction zone. Placement onto the stack 23 is then carried out directly downstream of the suction box 13.

At the downstream end of the stacking area and in the center thereof, upstream of the end stops 21, a further suction belt 27 extending in the travel direction 43 and to which a vacuum can be applied is above the supply travel plane. The suction belt 27 preferably has two suction zones arranged one downstream of the other in the travel direction 43, which are formed by suction chambers 28, 29 to which different levels of vacuum can be applied. The suction belt 27 circulates around the suction chambers 28, 29; a higher vacuum can be set by the upstream suction chamber 28 than by the downstream suction chamber 29. This makes it possible to reduce the conveying force on a sheet 16 immediately before the stops 21 are reached.

In order to prevent premature and uncontrolled sinking of a sheet 16 out of the supply travel plane in the stacking area, additional suction bars 31 are interleaved with the pneumatic transport bars 19, each having a slit-like suction opening extending beside the pneumatic transport bars 19 and together building up a two-dimensional vacuum that acts on the top side of the leading edge of an incoming sheet 16.

As illustrated in the figures, the apparatus has a housing 40 in which the various conveying, stacking and processing elements are fixed. According to the invention, the stacking elements acting on the top side of the stack 23 in the stacking area 41 and above the supply travel plane of the sheets 16 or reaching as far as above the supply travel plane are fixed in a separate frame 42 that is shown in the drawing with a dash-dotted line. The frame 42 is mounted in the housing 40 horizontally, preferably such that it can be moved in and counter to the sheet travel direction 43, as in the illustrated embodiment. In the illustrated embodiment, the stacking elements mounted in the frame 42 are the end stops 21, the side alignment elements 24, 25, the pneumatic transport bars 19, the suction belt 27 with the suction chambers 28, 29 thereof, and the pneumatic transport bars 19 with the compressed air source 20 thereof. In addition, the upper elements of the overlapping device namely the suction nozzles 32 and suction belts 17 on the outlet side, together with the suction box 18 around which they run, are mounted in the displaceable frame 42. This makes it possible to expose the top side of the perforated belts 14 at the end of the overlapping device by moving the elements above the perforated belts 14 downstream. Preferably, the frame 40 with the elements fixed thereto can be moved downstream out of the housing 40 completely, in order to replace the frame with a differently equipped second frame. To this end, lifting and transport means, by which a frame 42 with the elements fixed thereto can be picked up and transported away, are behind the housing 40.

The invention claimed is:

1. An apparatus for overlapping and stacking sheets, the apparatus comprising:

a housing defining a stacking area and a travel plane for the sheets;

transport means for conveying the sheets through the housing in a travel direction along a travel plane;

an overlapping device in the housing upstream of the stacking area for producing an overlapping stream of the conveyed sheets;

a brake in the overlapping device for slowing the conveyed sheets of the overlapping stream;

stacking elements including stops projecting upward in the stacking area and serving to position a stack formed by the conveyed sheets of the overlapping stream; and a separate frame carrying the stacking elements in the stacking area above the travel plane or extending to above the supply travel plane and mounted in the housing of the apparatus so as to be movable horizontally downstream in the direction away from the overlapping device, the overlapping device having above the travel plane conveying elements mounted in the separate frame and below the travel plane conveying elements fixed in the housing.

2. The apparatus as claimed in claim 1, wherein the frame is mounted such that it can be moved in and against the travel direction.

3. The apparatus as claimed in claim 1, wherein the frame with the elements fixed thereto can be moved completely out of the housing of the apparatus.

* * * * *